US007789097B1

(12) United States Patent
Sotirkys et al.

(10) Patent No.: US 7,789,097 B1
(45) Date of Patent: Sep. 7, 2010

(54) TAILGATOR/SUNSHADE PROTECTIVE COVER

(76) Inventors: Charles Peter Sotirkys, 7 Marion Way, Plymouth, MA (US) 02360; Kenn Weldon Medeiros, 254 Sandwich St., Plymouth, MA (US) 02360

( * ) Notice: Subject to any disclaimer, the term of this patent is extended or adjusted under 35 U.S.C. 154(b) by 0 days.

(21) Appl. No.: 12/228,637

(22) Filed: Aug. 15, 2008

(51) Int. Cl.
*E04H 15/06* (2006.01)

(52) U.S. Cl. ..... 135/88.01; 135/88.05

(58) Field of Classification Search ..... 135/88.01, 135/88.05, 88.06, 88.07
See application file for complete search history.

(56) References Cited

U.S. PATENT DOCUMENTS 3,223,098 A * 12/1965 Dole, Jr. ..... 135/126
5,546,971 A * 8/1996 Leonhardt ..... 135/127
5,927,311 A * 7/1999 Jager ..... 135/124
6,725,871 B1 * 4/2004 Shearer et al. ..... 135/88.01
7,108,005 B1 * 9/2006 Christenson et al. ..... 135/88.13
2007/0113879 A1 * 5/2007 Li ..... 135/88.07

* cited by examiner

*Primary Examiner*—David Dunn
*Assistant Examiner*—Noah Chandler Hawk
(74) *Attorney, Agent, or Firm*—John P. McGonagle

(57) ABSTRACT

A portable sunshade used in conjunction with and supported by a vehicle. The sunshade has a lightweight protective fabric cover engaged by a up to five flexible poles. The protective cover rear is magnetically attached to the vehicle. The protective cover front terminates in two fabric legs, which are engaged by an elongated, flexible pole inserted through the legs and the front of the protective cover. The leg bottoms are engaged by a footing or a stake driven into the ground. Removable sidings may also be attached to the protective cover for enclosing the area beneath the protective cover. The portable is easily assembled and disassembled.

11 Claims, 7 Drawing Sheets

TAILGATOR/SUNSHADE PROTECTIVE COVER

BACKGROUND OF THE INVENTION

This invention relates generally to sunshades, and in particular to a portable sunshade used in conjunction with and supported by a vehicle or other means of support to produce shade.

The increasing popularity of outdoor activity coupled with increasing use of automobiles and recreational type vehicles has led to increasing demand and need for various types of shelter and facilities which can be easily transported to a recreation site and then easily set up and used proximate a vehicle. There are many situations where shade is desirable for sporting participants and spectators to prevent heat exhaustion and dehydration. There is also the notable outgrowth of traditional picnics associated with sports events such as horse races, football games, and youth soccer, baseball and lacrosse games and tournaments. These events frequently occur in parking areas adjacent to the sports facility and/or fields and consist essentially of dining, snacking, resting and socializing prior to and during the event. The expression "tailgate party" has arisen from the fact that these events occur either at the rear end of a station wagon, pickup truck with its tailgate opened, SUV or passenger van with either rear of side doors open, or at the rear of a traditional sedan with the trunk open to accommodate the food, accouterments and grills for the party. Unfortunately, inclement weather as well as withering sun frequently occur; and the usual facilities provided near stadiums, race courses and playing fields do not provide much or convenient shelter.

It would therefore be highly desirable to have a portable shade or canopy which could be carried in a dissembled condition in the trunk or other available space of a vehicle and be easily assembled and erected to provide a temporary shelter adjacent the vehicle and temporarily forming an extension of the vehicle.

SUMMARY OF THE INVENTION

The present invention provides an easily assembled and disassembled sunshade used in conjunction with a vehicle or other means of support. The sunshade has a lightweight protective fabric cover engaged by a plurality of flexible rods. The protective cover rear is magnetically attached to the vehicle. The protective cover front terminates in two fabric legs, which are engaged by an elongated, flexible pole inserted through the legs and the front of the protective cover. The leg bottoms are engaged by a footing or a stake driven into the ground. Removable sidings may also be attached to the protective cover for enclosing the area beneath the protective cover.

These together with other objects of the invention, along with various features of novelty, which characterize the invention, are pointed out with particularity in the claims annexed hereto and forming a part of this disclosure. For a better understanding of the invention, its operating advantages and the specific objects attained by its uses, reference should be had to the accompanying descriptive matter in which there is illustrated a preferred embodiment of the invention.

DETAILED DESCRIPTION OF THE INVENTION

Figure 1:
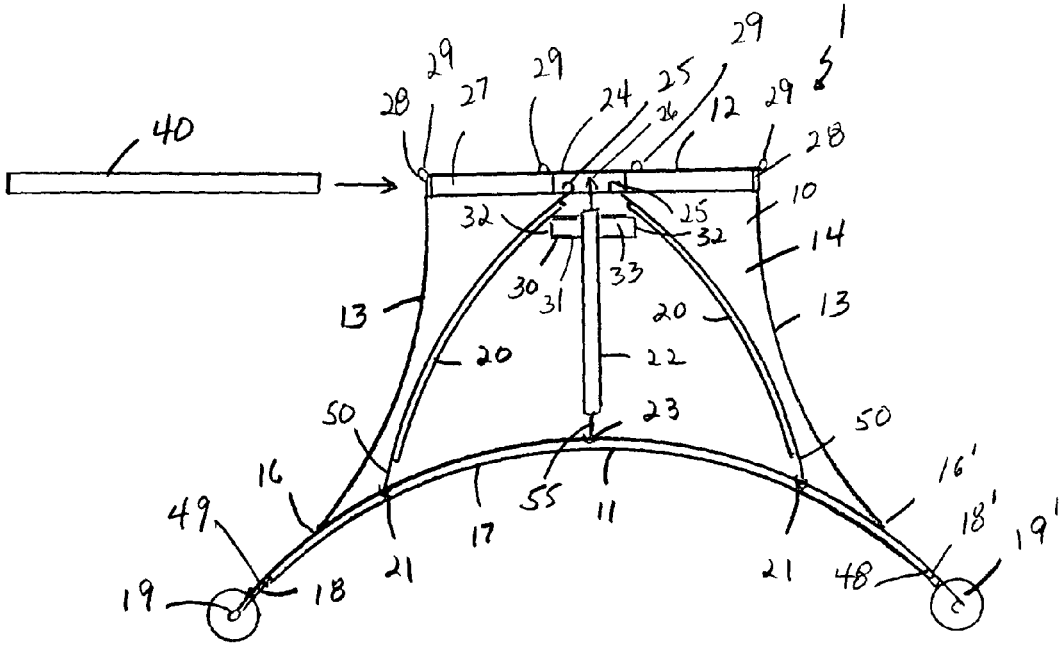
FIG. 1 is a top view of the tailgate sunshade.
Figure 2:
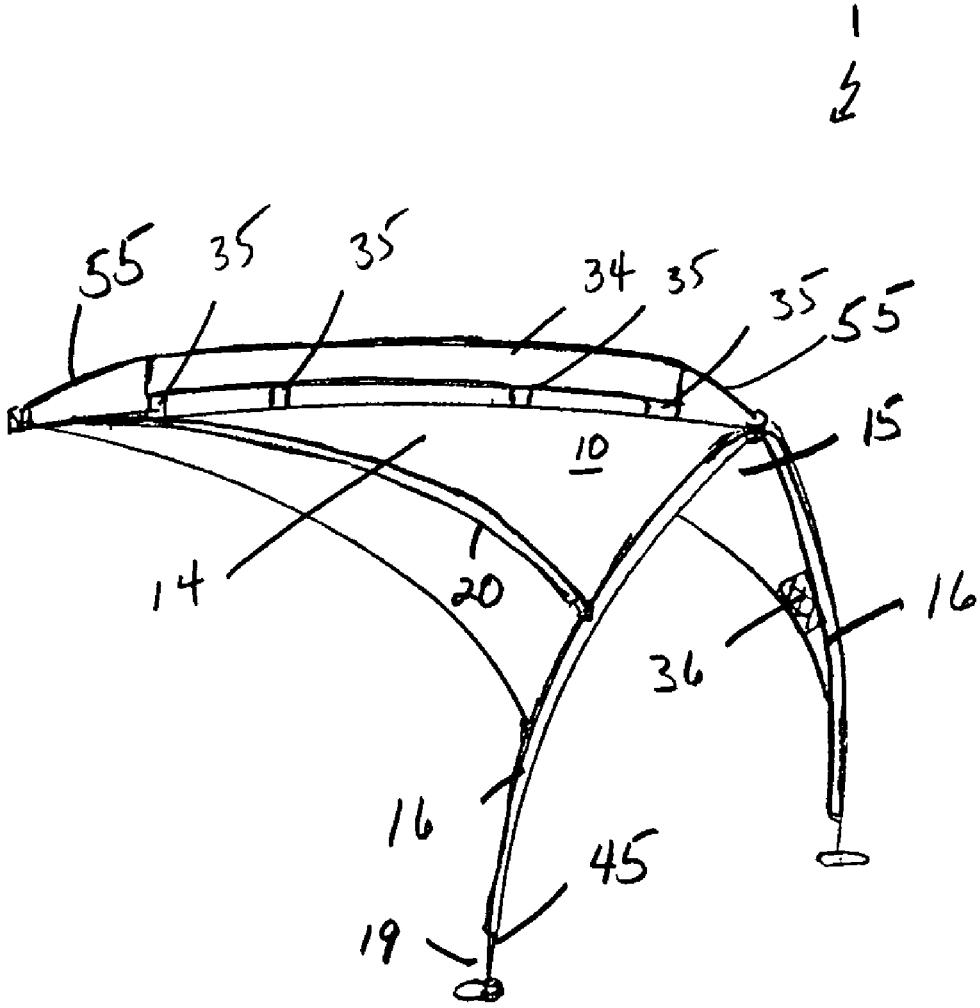
FIG. 2 is a side perspective view of the tailgate sunshade.
Figure 3A:
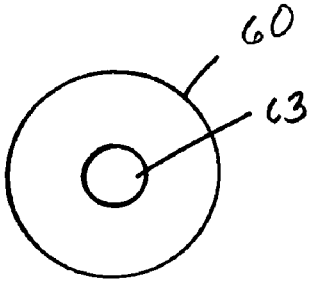
FIG. 3A is a top view of a footing.
Figure 3B:
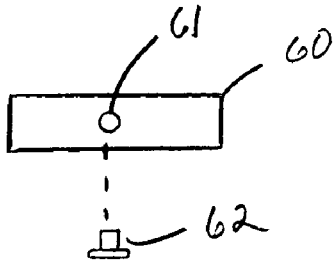
FIG. 3B is a side view of the footing.
Figure 4A:
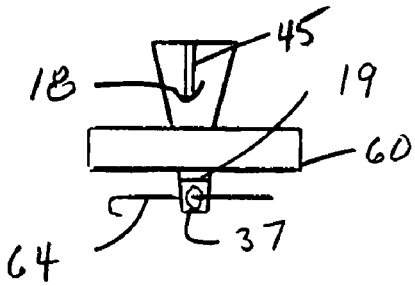
FIG. 4A is side view of a leg section bottom engaged with a footing.
Figure 4B:
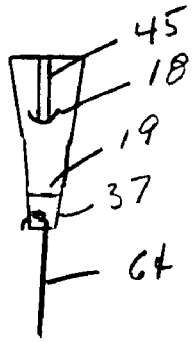
FIG. 4B is a side view of a leg section bottom engaged with a stake.
Figure 5:
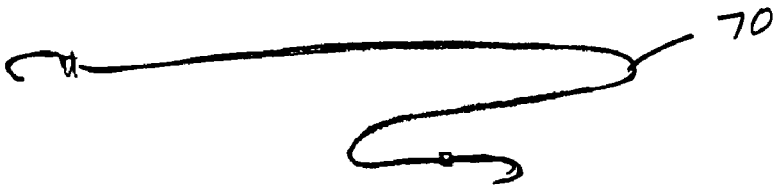
FIG. 5 is a side perspective view of a bungee type cord.

Referring to the drawing in detail wherein like elements are indicated by like numerals, there is shown a tailgate sunshade 1 constructed according to the principles of the present invention. The sunshade 1 is comprised of a protective cover 10, engaged by up to five collapsible poles 45, 50, 55, 65, a magnetic hold bar 40 for securing the protective cover rear 12 to a vehicle or other means of support, and two optional footings 60 for securing the protective cover front to the ground. Removable sidings 80 may also be attached to the protective cover 10 for enclosing the area beneath the protective cover. The tailgate sunshade 1 may be assembled from a dissembled state in less than five minutes. The dissembled tailgate sunshade weighs approximately 12 pounds and is stored in a bag 28" long×12" wide×4" high.

The protective cover 10 has a front 11, a rear 12, two opposite sides 13, a top surface 14 and an opposite bottom surface 15, said front and rear defining a protective cover longitudinal axis. The protective cover 10 is made from a lightweight fabric, which is water resistant and has U.V. protection. The protective cover front 11 terminates in two, downwardly extending leg sections 16, at the junctions of the protective cover front 11 and each protective cover side 13. A continuous sleeve 17 is formed near the bottom 19 of one leg section 16, extending across the protective cover front 11 down through the other leg section 16' near to the bottom 19' of the other section 16'. Each section 16, 16' has an upwardly opening pocket 18 attached near to the leg section bottoms 19, 19'.

The protective cover top surface 14 has two lateral sleeves 20 beginning adjacent the protective cover front 11 near to a side 13, and terminating near to the protective cover rear 12 adjacent a central pocket section 24. The protective cover front 11 has two, rearwardly opening pockets 21 attached thereto and facing the lateral sleeves 20. The protective cover top surface 14 also has a central sleeve 22 beginning centrally near to the protective cover front 11 and terminating near the central pocket section 24. The protective cover front 11 has a rearwardly facing central pocket 23 in alignment with the central sleeve 22. The central pocket section 24 is located centrally at the protective cover rear 12 and has three side-by-side forwardly facing pockets attached thereto. The two outside pockets 25 are aligned with the lateral sleeves 20. The center pocket 26 is aligned with the central sleeve 22. The protective cover rear 12 also has a holding sleeve 27 formed therein and extending from one opposite side 13 to the other opposite side 13'. The holding sleeve 27 is sealable at both ends by means of hook and pile fasteners 28 sold under the VELCRO trademarks. A plurality of webbing loops 29 are attached to the protective cover rear 12 at each side 13, 13' and along the rear 12, itself.

A mesh-covered, rectangular, wind vent 30 is centrally formed in the protective cover 10. The wind vent 30 is formed near to, but forward of, the central pocket section 24. The wind vent 30 has a nominal width dimension of fifteen inches (side-to-side) and a rear to front length of four inches. The wind vent 30 is loosely covered with a flap 33 continuously secured about the wind vent front 31 and sides 32. The wind vent 30 permits heat to escape from the protective cover bottom surface 15, and to provide a protective cover release for wind gusts.

The tailgate sunshade 1 is further comprised of a flexible, magnetic, hold bar 40 inserted into the holding sleeve 27 and secured therein by means of the VELCRO seals 28 at each end of the holding sleeve. The magnetic hold bar 40 is nominally six feet long and three inches wide. The magnetic hold bar 40 permits the protective cover rear 12 to be magnetically attached to a vehicle hood, roof, trunk or other metallic surface.

Figures 9A, 9B:
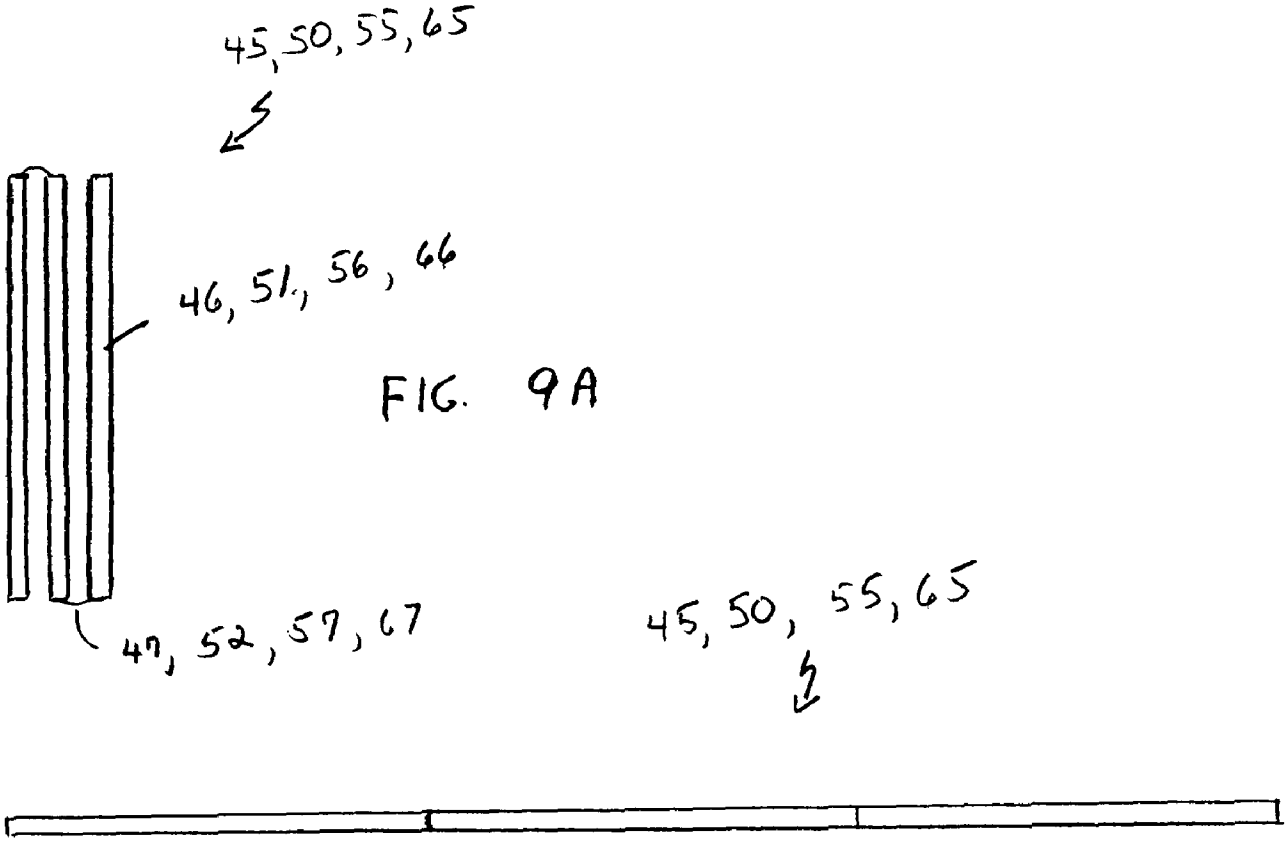
FIG. 9A is a view of a typical pole in a folded state.
FIG. 9B is a view of a typical pole in a deployed state.

The tailgate sunshade 1 is further comprised of a front pole 45 comprised of a plurality of collapsible, tent-type rods 46. In a preferred embodiment, the front pole is eighteen feet in length and is comprised of eight rods 46 elastically interconnected, end to end by means of a stretchable line 47. See FIGS. 9A and 9B for a typical pole construction. The front pole rods 46 are sequentially assembled while being inserted into the front sleeve 17. The front pole first end 48 is inserted into the continuous sleeve 17 beginning near one leg section bottom 19 and being threaded through the continuous sleeve 17 to the other leg section bottom 19'. The front pole first end 48 is inserted into the other leg section bottom pocket 18' and the front pole second end 49 is inserted into the initial leg section bottom pocket 18.

The tailgate sunshade 1 is further comprised of two, nine foot, lateral poles 50 comprised of four collapsible, tent-type rods 51 elastically interconnected, end to end by means of a stretchable line 52. Each lateral pole 50 is inserted into a lateral sleeve 20 and secured to a central pocket section lateral pocket 25 at one end and at the other end into a lateral sleeve pocket 21.

The tailgate sunshade 1 is further comprised of one central pole 55 comprised of three collapsible, tent-type rods 56 elastically interconnected, end to end by means of a stretchable line 57. The central pole 55 is inserted into the central sleeve 22 and secured to the central pocket section center pocket 26 at one end and at the other end into the central pocket 23.

In an alternate embodiment, the central sleeve 22 may be replaced by a separate, central, elongated sleeve 34 having a longitudinal axis parallel to the protective cover longitudinal axis. The separate, central, elongated sleeve 34 is attached to a protective cover central longitudinal axis by a plurality of webbing tabs 35. Four webbing tabs 35 are used in the preferred embodiment. Air can pass between the separate, central elongated sleeve 34 and the protective cover top surface 14. The advantages of this alternate embodiment, is that the separate, central elongated sleeve 34 provides a spine over the protective cover top surface 14 and may have logos, advertising, or the like, imprinted thereon. The separate, central elongated sleeve 34 also channels air longitudinally providing additional stability to the tailgate sunshade 1 in windy conditions.

Due to the separation dimensions of the sleeves and pockets, the front, lateral and central poles 45, 50, 55 are arched stretching out the cover 10 and providing arcuate shape and support to the protective cover 10. The leg sections 16 may also be provided with one or more mesh bags 36 having nominal dimensions of five inches wide by eight inches deep. The mesh bags 36 provide a place to store sun-glasses, keys, sun lotion, cigarettes, toys, and the like.

The tailgate sunshade 1 is further comprised of two footings 60, each comprised of a hollow, annular disk. Each disk 60 has a central aperture 63 and a radial aperture 61, said radial aperture permitting the disk to be filled with water, sand, or the like. A plug 62 is provided for each disk, each said plug adapted to seal a radial aperture 61. Each leg section bottom 19 terminates in a webbing loop 37. In operation, the webbing loop 37 is passed through the weighted disk open center 63. A stake 64 is then passed horizontally through the webbing loop 37 securing the footing to the protective cover leg section bottom 19. Alternatively, the footing 60 may be omitted and the stake 64 hooked onto the webbing loop 37 and vertically driven into a ground surface, thereby securing the protective cover leg section bottom 19 to a ground surface. See FIGS. 3A, 3B, 4A and 4B.

Figure 6:
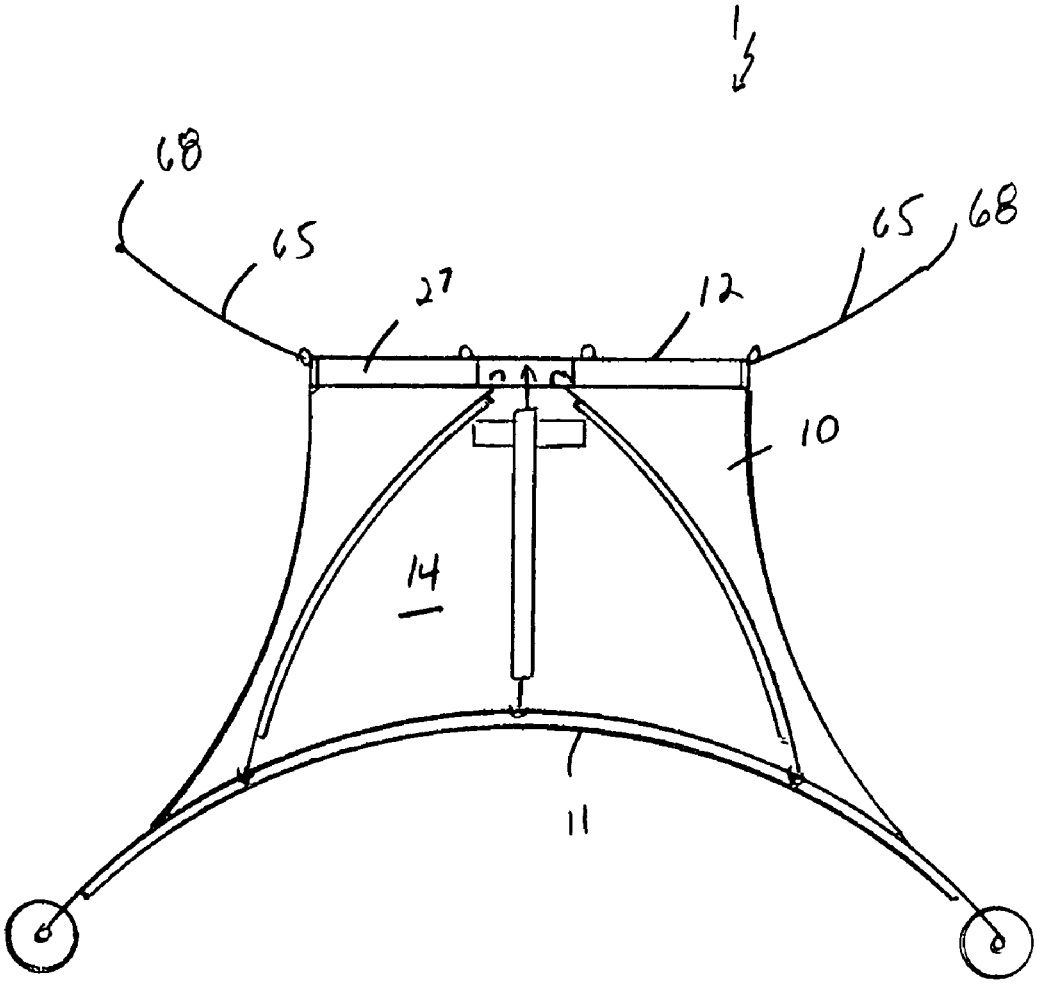
FIG. 6 is a top view of the tailgate sunshade with an attachment pole.

The tailgate sunshade 1 is also provided with an attachment pole 65 to assist in attaching the protective cover 10 to a pickup truck. The attachment pole 65 has a length of nearly fourteen feet and is comprised of six collapsible, tent-type rods 66 elastically interconnected, end-to-end, by means of a stretchable line 67. The attachment pole 65 is inserted into and through the protective cover rear holding sleeve 27 in parallel with the magnetic strip 40. The attachment pole ends 68 protrude from the holding sleeve 27 and engage existing utility holes in the pickup truck bed. See FIG. 6.

The tailgate sunshade 1 is further comprised of two bungee-type cords 70 for additional anchoring of the protective cover rear 12. Each cord 70 engages a webbing loop 29 at each protective cover side 13, 13' and anchors the protective cover rear 12 to a vehicle wheel well, bumper or other vehicle anchoring point.

Figure 7:
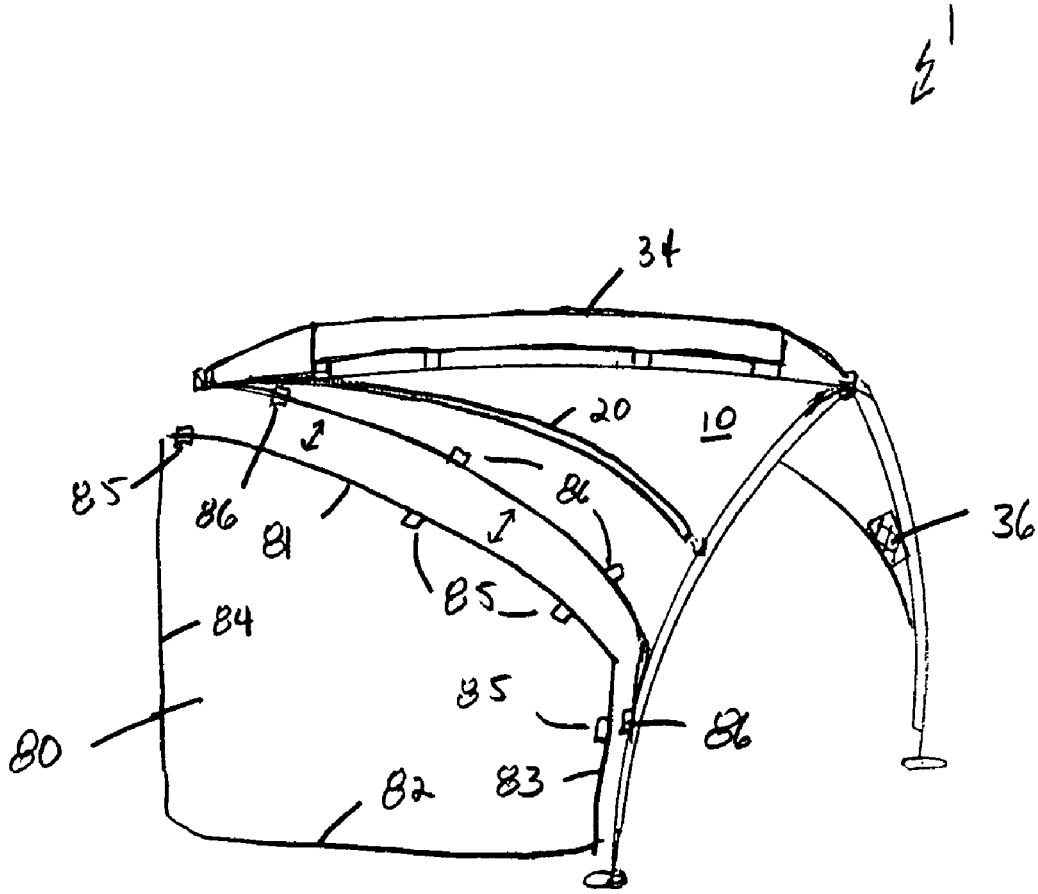
FIG. 7 is a side perspective view of the tailgate sunshade with an attachable siding.
Figure 8:
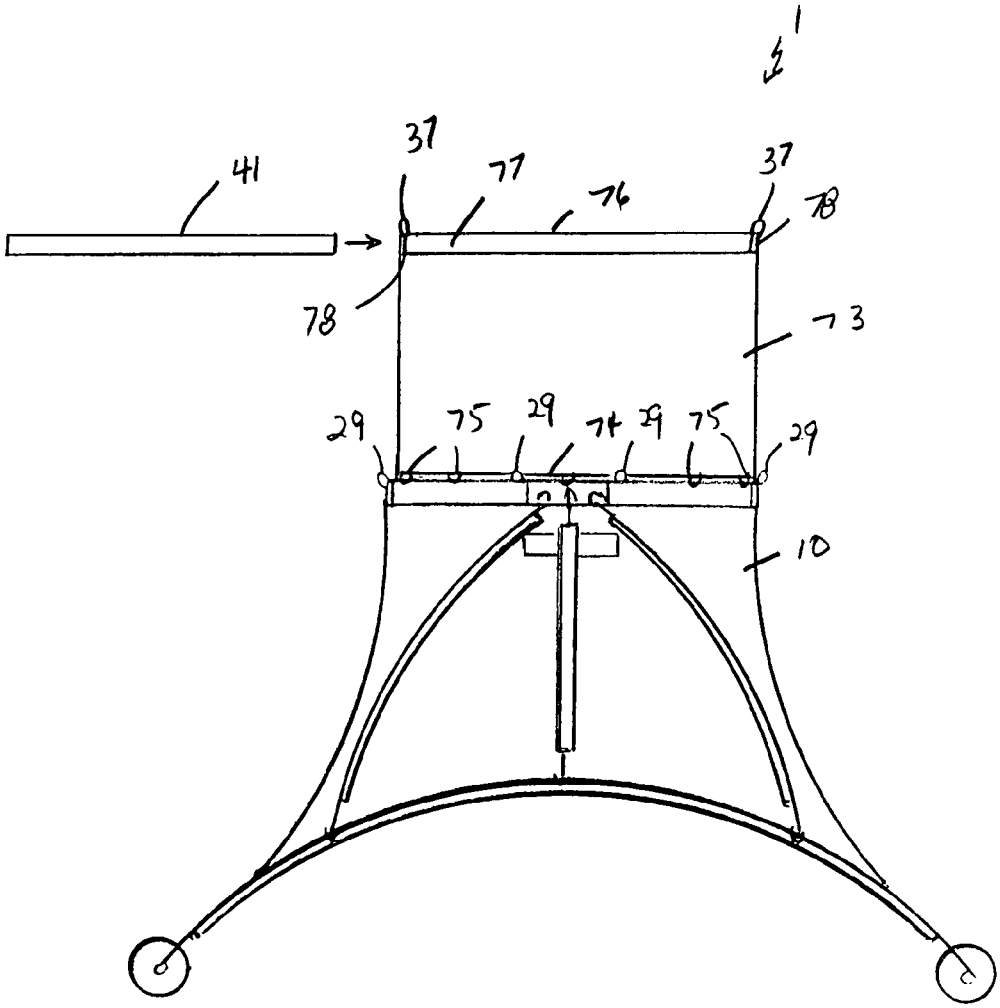
FIG. 8 is a top view of the tailgate sunshade with a bed shade cover.

The tailgate sunshade 1 has an optional extended bed shade cover 73 for use especially with pickup trucks. The bed shade cover 73 has a generally rectangular shape. The bed shade cover has a proximal end 74 with a plurality of webbing loops 75 and a distal end 76 with a sleeve 77 formed therein. The bed shade cover sleeve 77 is sealable at both ends by means of VELCRO fasteners 78. A flexible, magnetic, hold bar 41 is inserted into the bed shade cover sleeve 77 and provides means for attaching the bed shade cover distal end 76 to the cab of a pickup truck or other desired surface. The bed shade cover proximal end 74 is attached to the protective cover rear 12 by inserting a bungee cord 70 through the bed shade cover webbing loops 75 and the protective shade cover rear webbing loops 29. See FIG. 8, Removable sidings 80 may also be attached to the protective cover 10 for enclosing the area beneath the protective cover. The sidings 80 may be comprised of screening or clear plastic. The sidings 80 have a top edge 81, a bottom edge 82, a forward edge 83 and a rear edge 84. Velcro fasteners 85 are attached to the siding front and top edges. Corresponding fasteners 86 are attached to the protective cover sides 13 and leg sections 16. Zippers may be used in place of the Velcro fasteners. See FIG. 7.

It is understood that the above-described embodiment is merely illustrative of the application. Other embodiments may be readily devised by those skilled in the art, which will embody the principles of the invention and fall within the spirit and scope thereof.

We claim:

1. A sunshade used in conjunction with a vehicle, comprising:

a protective cover having a front, a rear, two opposite sides, a top surface and an opposite bottom surface, said front and rear defining a protective cover longitudinal axis, said cover front terminating in two, downwardly extending leg sections, at the junctions of the protective cover front and each protective cover side;

a continuous sleeve in one leg section near a bottom of said leg section, extending in and across the protective cover front down through the other leg section near to a bottom of the other leg section;

an upwardly opening pocket attached near to the leg section bottom of each leg each section;

two lateral sleeves formed in the protective cover top surface, each said sleeve beginning adjacent the protective cover front near to a side, and terminating near to the protective cover rear adjacent a central pocket section;

two, rearwardly opening pockets attached to the protective cover front and facing the lateral sleeves;

a central sleeve connected to said protective cover top surface, said central sleeve beginning centrally near to the protective cover front and terminating near the central pocket section;

a rearwardly facing central pocket attached to said protective cover front in alignment with the central sleeve;

wherein the central pocket section is located centrally at the protective cover rear and has three side-by-side forwardly facing pockets attached thereto, wherein two outside pockets are aligned with the lateral sleeves and a center pocket is aligned with the central sleeve;

a holding sleeve formed at the protective cover rear and extending from one opposite side to the other opposite side, said holding sleeve having opposite sealable ends;

a flexible, magnetic hold bar for securing the protective cover rear to a vehicle, said magnetic hold bar inserted into said holding sleeve;

a plurality of flexible, collapsible poles engaging said protective cover, comprising;

a front pole comprised of a plurality of rods elastically interconnected, end to end, by means of a stretchable line, said front pole positioned within said continuous sleeve, said front pole having two ends, each end being inserted into a said upwardly opening pocket attached near to the leg section bottoms;

two lateral poles comprised of a plurality of rods elastically interconnected, end to end, by means of a stretchable line, each said lateral pole positioned within a said lateral sleeve, each said lateral pole having two ends, one end being inserted into a said central pocket section lateral pocket and the other end into a said rearwardly opening pocket facing a lateral sleeve;

a central pole comprised of a plurality of rods elastically interconnected, end to end, by means of a stretchable line, said central pole positioned within said central sleeve, said central pole having two ends, one end being inserted into said central pocket section center pocket and the other end into said rearwardly facing central pocket;

a webbing loop attached to the bottom of each said leg section; and two stakes, one for engaging each said leg section webbing loop and securing each said leg section bottom to a ground surface.

2. A sunshade as recited in claim 1, wherein:

the central sleeve is comprised of a separate, central, elongated sleeve having a longitudinal axis parallel to the protective cover longitudinal axis, said separate, central, elongated sleeve being attached to a protective cover central longitudinal axis by a plurality of webbing tabs.

3. A sunshade as recited in claim 2, further comprising:

a plurality of webbing loops attached to the protective cover rear at each side and along the protective cover rear.

4. A sunshade as recited in claim 3, further comprising:

two bungee-type cords, each said bungee cord having an end engaging a said webbing loop at each protective cover side and another end engaging a vehicle anchoring point.

5. A sunshade as recited in claim 4, further comprising:

two footings, each comprised of a hollow, annular disk having a central aperture and a radial aperture, said radial aperture adapted to permitting the disk to be filled with a weight substance, each said footing adapted to rest on a ground surface;

two plugs, each said plug adapted to seal a disk radial aperture;

wherein each leg section bottom webbing loop is positioned through the weighted disk central aperture;

wherein each said stake horizontally engages a said leg section webbing loop securing the footing to the protective cover leg section bottom.

6. A sunshade as recited in claim 5, further comprising:

a mesh-covered, rectangular, wind vent centrally formed in the protective cover, near to, and forward of the central pocket section, said wind vent having a front, a rear, and two sides;

a loose flap continuously secured about the wind vent front and sides.

7. A sunshade as recited in claim 6, wherein:

the protective cover is made from a lightweight, water-resistant fabric having ultra violet protection.

8. A sunshade as recited in claim 6, further comprising:

a plurality of mesh bags attached to said leg sections.

9. A sunshade as recited in claim 8, further comprising:

an attachment pole comprised of a plurality of rods interconnected, end-to-end, by means of a stretchable line, said attachment pole positioned within said protective cover rear holding sleeve and having ends protruding from said protective cover rear holding sleeve, said attachment pole ends each adapted to engage a pickup truck bed existing utility hole.

10. A sunshade as recited in claim 8, further comprising:

two sidings removably attached to the protective cover for enclosing an area beneath the protective cover, said sidings having a top edge, a bottom edge, a forward edge and a rear edge;

a plurality of siding fasteners are attached to the siding front and top edges;

a plurality of protective cover fasteners attached to the protective cover sides and leg sections, said protective cover fasteners adapted to engage the siding fasteners.

11. A sunshade as recited in claim 8, further comprising:

a generally rectangular, extended, truck bed shade cover having a proximal side with a plurality of webbing loops attached thereto and an opposite distal side with a sleeve having two sealable ends formed therein;

a flexible, magnetic, hold bar positioned within said bed shade cover sleeve and provides means for attaching the bed shade cover distal end to truck cab;

a bungee-type cord inserted through the bed shade cover proximal end webbing loops and the protective shade cover rear webbing loops.

* * * * *